US007154563B1

(12) United States Patent
Takeda et al.

(10) Patent No.: US 7,154,563 B1
(45) Date of Patent: Dec. 26, 2006

(54) AUTOMATIC BRIGHTNESS LIMITATION FOR AVOIDING VIDEO SIGNAL CLIPPING

(75) Inventors: Ryo Takeda, Kurashiki (JP); Shigeharu Ochi, Niihama (JP); Takeshi Tange, Niihama (JP); Takao Ogawa, Kurashiki (JP)

(73) Assignee: STMicroelectronics Asia Pacific Pte Ltd., Singapore (SG)

( * ) Notice: Subject to any disclaimer, the term of this patent is extended or adjusted under 35 U.S.C. 154(b) by 0 days.

(21) Appl. No.: 09/674,355

(22) PCT Filed: Apr. 30, 1998

(86) PCT No.: PCT/SG98/00031

§ 371 (c)(1),
(2), (4) Date: Nov. 2, 2000

(87) PCT Pub. No.: WO99/57892

PCT Pub. Date: Nov. 11, 1999

(30) Foreign Application Priority Data

Feb. 16, 1999 (JP) ..... 11-037812
Mar. 3, 1999 (JP) ..... 11-055925
Aug. 11, 1999 (JP) ..... 11-227623

(51) Int. Cl.
*H04N 9/68* (2006.01)

(52) U.S. Cl. ..... 348/679; 348/645; 348/684; 348/692

(58) Field of Classification Search ..... 348/645, 348/647, 655, 656, 657, 659, 673, 677, 678, 348/679, 686, 687, 689, 690
See application file for complete search history.

(56) References Cited

U.S. PATENT DOCUMENTS 4,295,166 A * 10/1981 Shanley, II et al. ..... 348/684
4,298,885 A * 11/1981 Okada ..... 348/679
4,489,349 A * 12/1984 Okada ..... 348/674
4,599,643 A * 7/1986 Harlan ..... 348/380
4,797,733 A * 1/1989 Takagi et al. ..... 348/225.1
5,040,065 A * 8/1991 Vilard ..... 348/678
5,317,400 A * 5/1994 Gurley et al. ..... 348/679
5,400,086 A * 3/1995 Sano et al. ..... 348/678
5,504,538 A * 4/1996 Tsujihara et al. ..... 348/673
6,097,445 A * 8/2000 Goto et al. ..... 348/655

* cited by examiner

*Primary Examiner*—David Ometz
*Assistant Examiner*—Trang U. Tran
(74) *Attorney, Agent, or Firm*—Lisa K. Jorgenson; E. Russell Tarleton; Seed IP Law Group PLLC

(57) ABSTRACT

A brightness limitation system is employed in a television circuit to prevent the black reference voltage level and the video signal from entering a minimum signal clipping zone, to provide precise correction signal, limiting the brightness, to maintain a constant black reference voltage level, and maintain a video signal with dynamic amplitude. The brightness limitation circuit detects a minimum signal level amongst the black reference signals from each color channel and compares the minimum signal with a fixed voltage level to generate a brightness feedback signal. The brightness feedback signal is then used to modify the black reference signal level for each color channel.

17 Claims, 8 Drawing Sheets

AUTOMATIC BRIGHTNESS LIMITATION FOR AVOIDING VIDEO SIGNAL CLIPPING

FIELD OF THE INVENTION

This invention relates to a method and apparatus for avoiding signal clipping in a video signal by automatically controlling brightness limitations.

BACKGROUND ART

Television circuits are commonly designed or modified so as to further integrate the functions thereof to enable operation with low power consumption. However, discrepancies can arise when the power supply is reduced. For example, a clipping effect may occur when the signals reach a minimum or maximum voltage level. The signal may deteriorate in shape in these circumstances.

As far as a waveform is concerned, the television circuit requires a signal to be maintained with desired dynamic amplitude, even if the power supply is reduced. Therefore, preventative measures may be required with the implementation of a brightness limitation block to avoid the black reference voltage level and the video signals from reaching undesirable levels. Furthermore, the black reference voltage level should be controlled in a constant manner.

SUMMARY OF THE INVENTION

In accordance with the present invention, there is provided a video signal processing system that includes, for each colour channel, a control circuit and clamping circuit for generating a colour channel reference signal and controlling a colour channel video signal, and a brightness limitation circuit coupled to receive the colour channel reference signal from each of the colour channels and coupled to provide a feedback signal to regulate a brightness level of each video signal according to a comparison of a minimum signal level amongst the colour channel reference signals and a fixed reference signal level.

Preferably the brightness limitation circuit comprises a minimum detection circuit for detecting and outputting a minimum signal level from amongst the colour channel reference signals, and a comparator having as inputs the fixed reference signal level and the minimum signal level, so as to produce the feedback signal as output. In a particular embodiment of the invention, the comparator is coupled to receive the minimum signal level at its negative input and the fixed reference signal level at its positive input.

Preferably each control circuit includes a plurality of adders coupled in the signal path of the corresponding colour channel reference signal, wherein the feedback signal is coupled as input to one of the adders. The feedback signal may be coupled from the brightness limitation circuit to the control circuit by way of a brightness control circuit which enables manual brightness adjustment of the colour channels.

In one form of the invention each control circuit includes an adder circuit coupled in the signal path of the corresponding colour channel video signal, wherein a feedback signal from the clamping circuit, generated according to the colour channel video signal and the colour channel reference signal, is coupled as input to the adder circuit.

The present invention also provides a video signal processing circuit for regulating colour channel video information signals, comprising a minimum signal detector for detecting a minimum signal level amongst a plurality of colour channel reference signals, a comparator which compares the minimum signal level with a fixed voltage reference signal and generates a corresponding output, and an additive feedback coupling of the comparator output signal and each of the colour channel reference signals.

The present invention further provides a video signal brightness controller that includes a plurality of colour channel control means each coupled to receive as input a respective colour channel video signal and colour channel reference signal and generate a respective adjusted colour channel video signal and adjusted colour channel reference signal;

a plurality of clamping means, each clamping means corresponding to a respective colour channel control means and being coupled to receive as input the respective adjusted colour channel video signal and adjusted colour channel reference signal and produce a corresponding clamping feedback signal; and a brightness limitation means coupled to receive the adjusted colour channel reference signal from each colour channel control means and produce a corresponding brightness feedback signal; wherein each of the colour channel control means includes a first adder in path of the colour channel video signal, to which the clamping feedback signal is coupled, and a second adder in the path of the colour channel reference signal, to which the brightness feedback signal is coupled.

BRIEF DESCRIPTION OF THE DRAWINGS

The invention is described in greater detail hereinafter, by way of example only, with reference to a preferred embodiment thereof and the accompanying drawings, wherein.

DETAILED DESCRIPTION OF THE PREFERRED EMBODIMENTS

Figure 1:
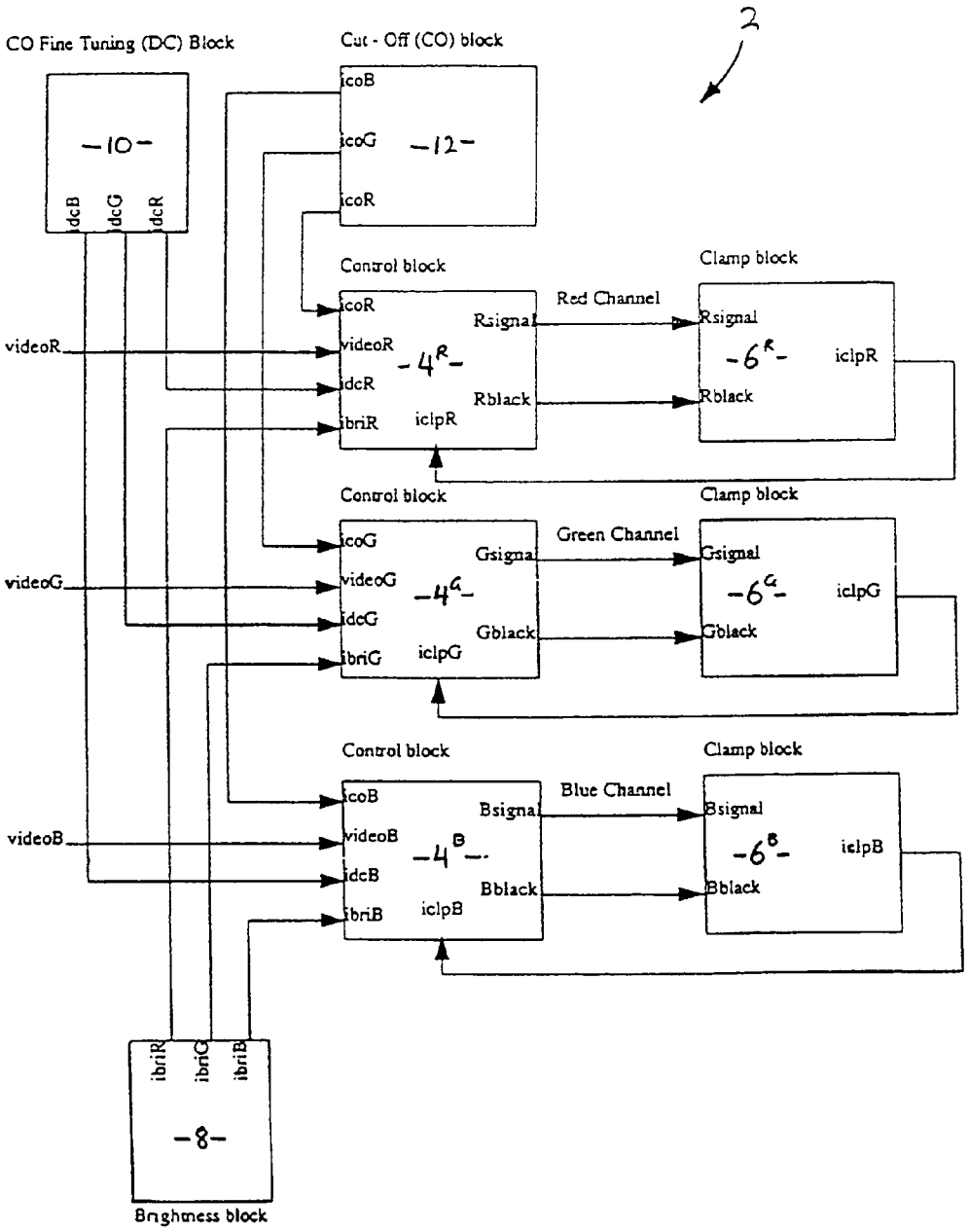
FIG. 1 is a functional block diagram illustrating a known television signal control system.

FIG. 1 shows a fundamental functional block diagram of an existing system 2 for controlling the signals of red, green and blue channels before these signals are distributed to the display tube of a television. Basically, this system includes, for each of the red, green and blue channels, a control block ($\mathbf{4}^R$, $\mathbf{4}^G$, $\mathbf{4}^B$) and a clamp block ($\mathbf{6}^R$, $\mathbf{6}^G$, $\mathbf{6}^B$), a brightness block 8, a cut-off (CO) fine tuning (DC) block 10 and a cut-off (CO) block 12. Since the control and clamp blocks are identical for each channel, only the red channel is discussed hereinbelow in the interests of clarity.

The control block 4 is mainly constructed using adders to control the video signals to present perfect pictures for display on the television screen. The appropriate CO brightness DC and clamping input signals are mixed together to generate accurate output signals, Rsignal, Gsignal, Bsignal, Rblack, Gblack and Bblack. The generated output Rsignal is an output signal that contains video information, while Rblack is an output signal that provides a black reference voltage level. The control block, however, is sensitive to the signals with low voltage, as discussed in greater detail hereinbelow.

Figure 2:
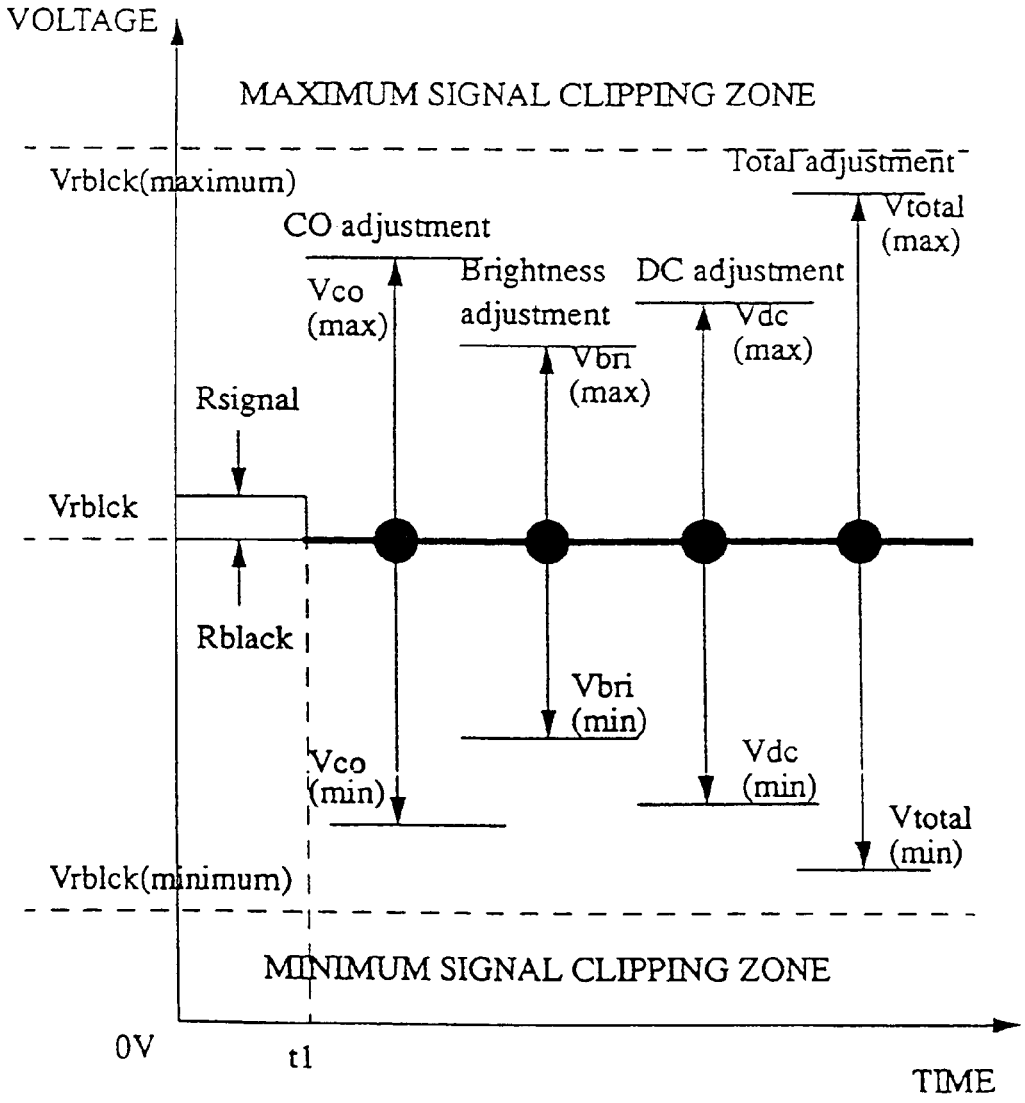
FIG. 2 is an illustration of a brightness curve.

The clamp block 6 receives Rsignal and Rblack as input signals from the control block 4. The clamp block is used to clamp the Rsignal signal, which means that Rsignal is aligned with the Rblack signal, as illustrated in FIG. 2, to maintain a stable black level or picture brightness. The output signal from the clamp block 6, iclpR is fed back to the control block 4 to determine the amplitude difference between the Rsignal and Rblack signals for performing further alignment if necessary.

The brightness block 8 is used to adjust the black reference voltage level Rblack. Brightness can be adjusted by the user with the use of remote control or from the television set itself. The CO fine tuning (DC) block 10 is used to fine tune the black reference voltage level which is controlled by the internal circuit as described below. The signals for brightness adjustment consists of ibriR, ibriG and ibriB, and the signals for DC adjustment comprise idcR, idcG and idcB, and are passed to the respective control blocks (FIG. 1).

The cut off block 12 is used to control the red, green and blue electron guns so as to provide an accurate black reference voltage level. This is required because signals for the electron guns have a high spread. Manual cut off adjustment is usually performed at the manufacturing stage. Tuning has to be done if the quality of one colour is different from a defined colour. This adjustment is made with the use of a potentiometer or by bus control whereby information is stored in a memory circuit of the television. On the other hand, automatic cut off adjustment can be done with a feedback loop configuration. Both methods allow correction signals of icoR, icoG and icoB to be varied from Vco(min) to Vco(max) as shown in FIG. 2.

With reference to FIG. 2, Rblack is an output signal that provides a black reference voltage level which is used for clamping purpose so that a constant black level can be maintained. Rsignal is an output signal which contains the red channel video information. A maximum signal clipping zone and minimum signal clipping zone are indicated in the figure and are referred to as forbidden zones, whereby both Rsignal and Rblack signals are prohibited from falling into these zones. However, the Rsignal signal can be fine tuned and adjusted with three adjustments. Namely, cut-off (CO) adjustment, brightness adjustment and CO fine tuning (DC) adjustment. Taking Vrblck as the black reference voltage level, the Rblack signal is able to swing from Vco(min) to Vco(max) when CO adjustment is being tuned. Similarly the Rblack signal is able to swing from Vbri(min) to Vbri(max) when brightness adjustment is being tuned. Likewise, the Rblack signal is able swing from Vdc(min) to Vdc(max) when DC adjustment is being tuned. During initialization, at time t1, when the television set is turned on, the Rsignal signal has to be aligned along the Rblack signal progressively. Alternately, alignment has to be made when any of the three adjustments has been fine tuned or adjusted. As a result, the signal of Rsignal also has a constant black level as it is in line with the Rblack signal.

Total adjustment is the addition of CO adjustment, brightness adjustment and DC adjustment. An equation of for the overall adjustment Vtotal is as shown below:

$$\text{Total adjustment} = CO\ \text{adjustment} + \text{brightness adjustment} + DC\ \text{adjustment} \quad \text{(Equ. 1)}$$

$$V\text{total} = Vco + Vbri + Vdc \quad \text{(Equ. 2)}$$

Figure 3:
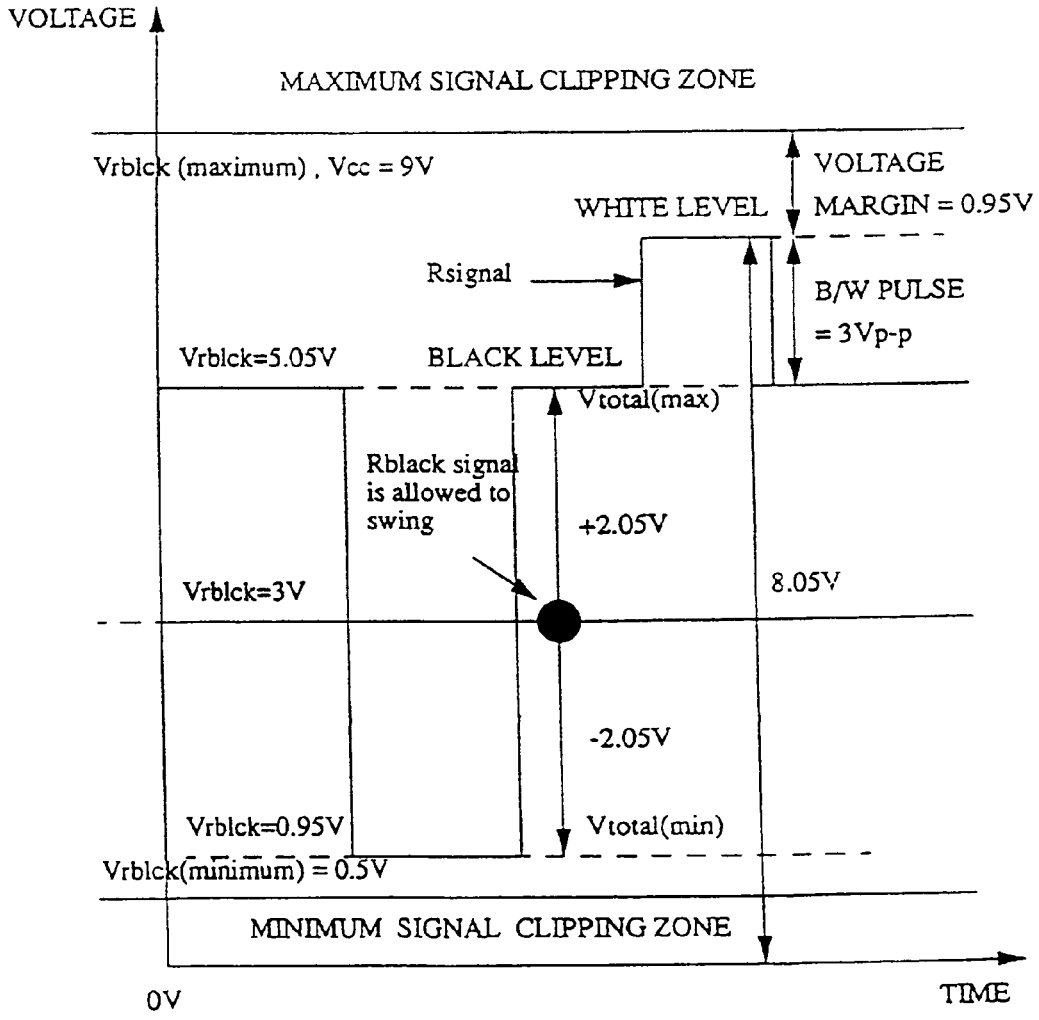
FIGS. 3 and 4 illustrate video signals from a known system.

FIG. 3 illustrates a video signal obtained from an existing system that operates with a 9 Volt power supply. Various voltages for the system as shown in Table 1, below, are based on assumption only.

TABLE 1

| Names of Waveform | Voltage (Volt) |
|---|---|
| Black to White (B/W) Pulse | 3 Vp-p |
| Vrblck (typical) | 3 volts |
| Vco (Maximum/Minimum) | +/−1 Volt |
| Vbri (Maximum/Minimum) | +/−0.9 Volt |
| Vdc (Maximum/Minimum) | +/−0.15 Volt |

To compute the voltages of Vtotal(max) and Vtotal(min)

from $$Vtotal = Vco + Vbri + Vdc \quad \text{(Equ. 2)}$$
$$Vtotal(\max) = (1 + 0.9 + 0.15)\ \text{Volts} = +2.05\ \text{Volts}$$

from $$Vtotal = Vco + Vbri + Vdc \quad \text{(Equ. 2)}$$
$$Vtotal(\min) = (-1 - 0.9 - 0.15)\ \text{Volts} = -2.05\ \text{Volts}$$

Typically, Rblack signal is set at the black reference voltage level (Vrblck) which is 3 Volts. Based on the calculation as shown above, this signal is allowed to swing positive by 2.05 Volts and negative by 2.05 Volts. In other words, it is able to vary from 0.95 Volt to 5.05 Volts. A further 3 Volts is required by the black to white (B/W) pulse with the contrast level set to maximum. Hence, the maximum level of the video signal is 8.05 Volts. A voltage margin of 0.95 Volts is reserved for sharpness adjustment and over modulation to occur. As such neither of the Rsignal and Rblack signals falls into the maximum and minimum signal limitation zones. Thus, no problem is encountered with typical video amplitude.

Figure 4:
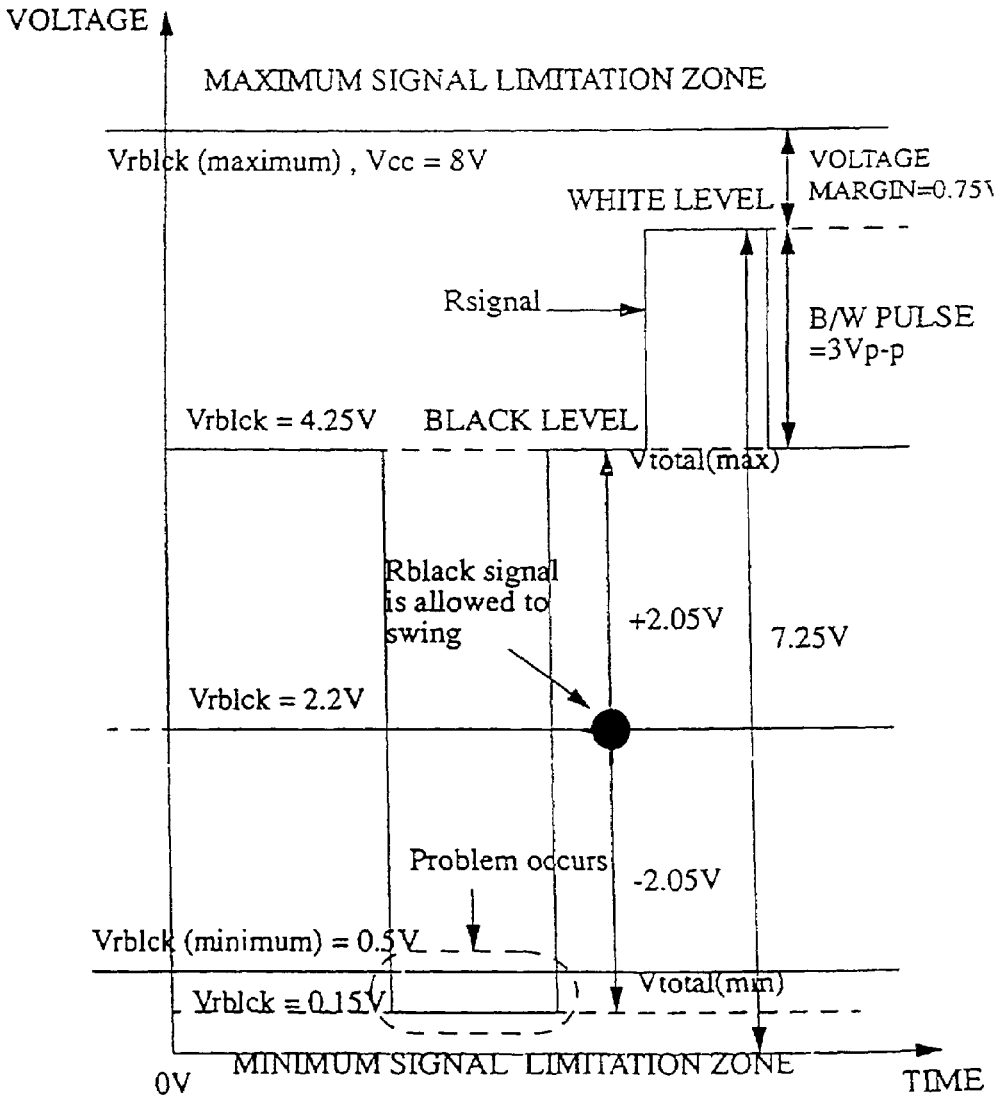

FIG. 4 illustrates a video signal obtained from an existing system that operates with an 8 Volt power supply. The objective of power supply reduction is to achieve a system that is able to function with low power consumption. At the same time, it must be able to maintain a video signal with reasonable dynamic amplitude. However, difficulties have been encountered in these circumstances.

The black reference voltage level (Vrblck) is compensated to 2.2 Volts as the power supply is reduced by 1 Volt. Similarly, Vrblck is allowed to swing positive by 2.05 Volts and negative by 2.05 Volts. Likewise, 3 Volts is required by the black to white pulse with the contrast level set to maximum. Hence, the maximum level of the video signal is 7.25 Volts.

To compute the range of Vrblck level, consider the following:

Let Vrblck be the final result of the black reference voltage level, and

Vrblck(current) be the present black reference voltage level.

$$\text{Therefore, } Vrblck = Vrblck(\text{current}) + Vtotal \quad \text{(Equ. 3)}$$

$$Vrblck(\text{maximum}) = (2.2 + 2.05)\ \text{Volts} = 4.25\ \text{Volts and } Vrblck(\text{minimum}) = (2.2 - 2.05)\ \text{Volt} = 0.15\ \text{Volt}$$

Based on the calculated results, the Rblack signal is only allowed to vary from 0.15 Volts to 4.25 Volts in this instance. A voltage margin of 0.75 Volt is reserved for further B/W pulse adjustment as mentioned before. This implies that the maximum signal clipping zone is not affected, however the minimum signal clipping zone is affected by the Rblack signal.

Figure 5:
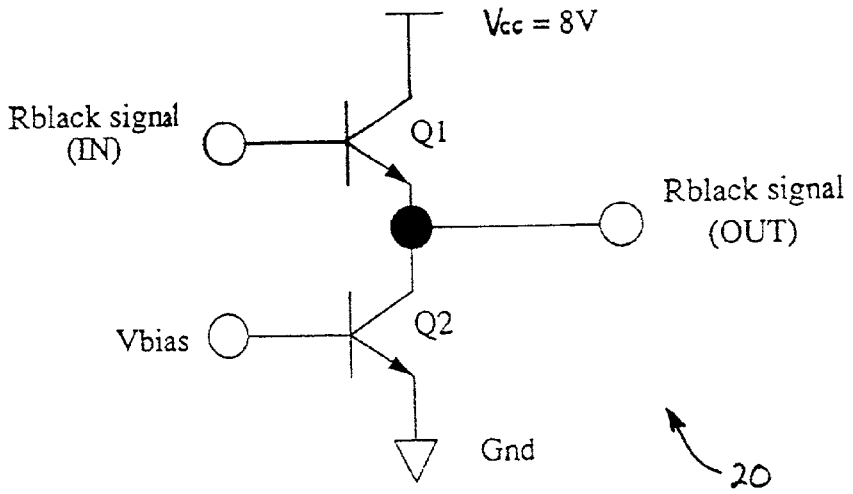
FIG. 5 is a circuit diagram of an output portion of a control block.

FIG. 5 shows a circuit 20 of an output portion of a control block. Basically, it consists of an emitter follower Q1 coupled to a transistor Q2 which is biased at a fixed voltage, Vbias. Assume that, the Rblack signal (OUT) is allowed to fall to a voltage level of Vrblck(minimum) which is as low as 0.5 Volt. Based on the calculation as shown above, it shows that Rblack signal (OUT) has reached to a voltage level of 0.15 Volt. This implies that the Rblack signal has already fallen into the minimum signal limitation zone. Hence, the voltage level (Vrblck) of Rblack signal is too low for Q2 to function properly. As such, it causes Q2 to operate in saturation.

In order to alleviate this problem, the television circuit can be equipped with a brightness limitation block, which can provide the following:

1. Prevention of the black reference voltage level (Rblack) and the video signal (Rsignal) from entering into the minimum signal clipping zone.
2. Provision of the brightness block with a precise correction signal, limiting the brightness.
3. Maintenance of a constant black reference voltage level at Vrblck minimum.
4. Maintenance of a video signal with dynamic amplitude.

Figure 6:
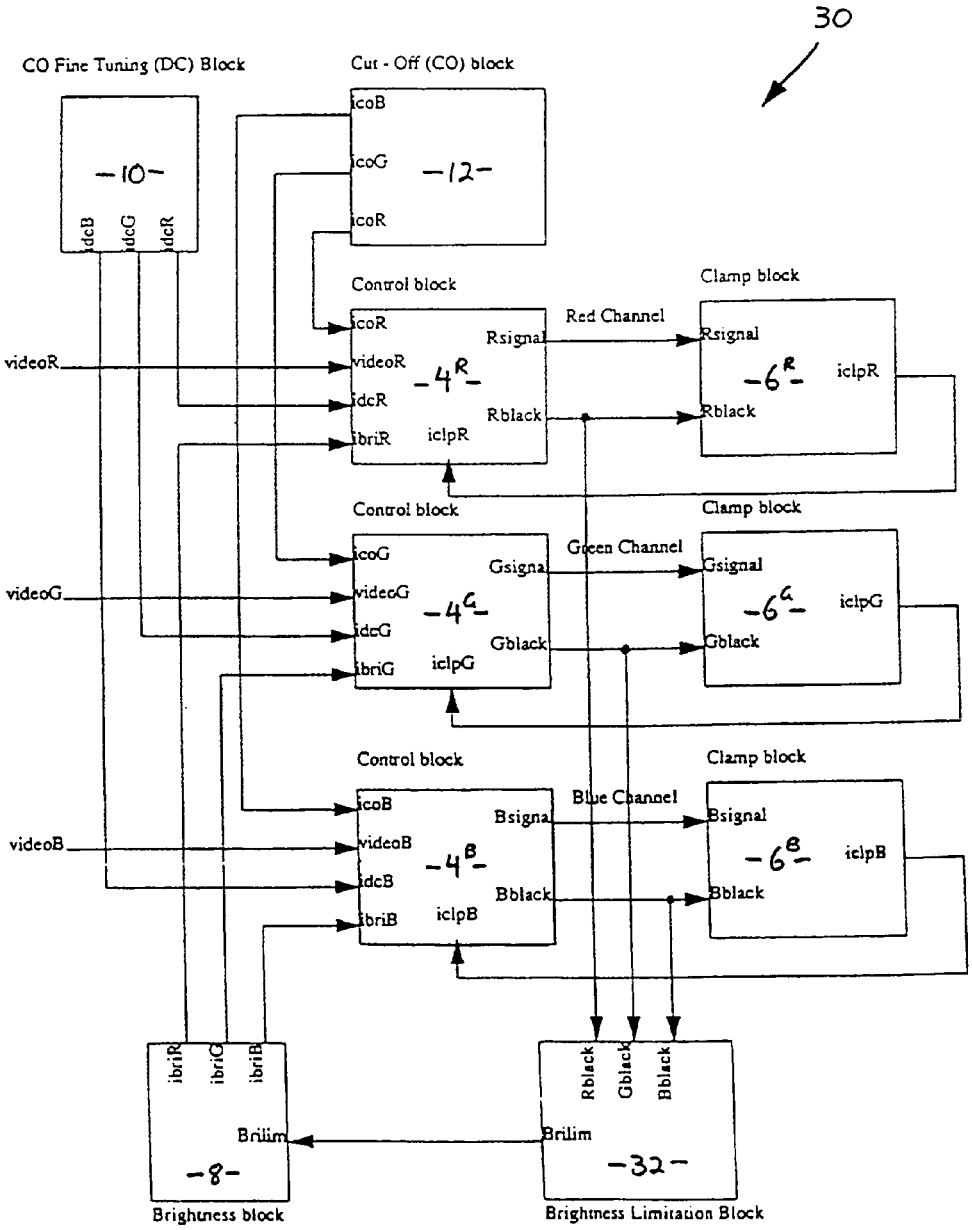
FIG. 6 is a functional block diagram of a television signal control system incorporating a brightness limitation block according to an embodiment of the present invention.

In order to overcome the above mentioned difficulties, a brightness limitation block 32 can be implemented in the system 30 as shown in FIG. 6. Signals of Rblack, Gblack, and Bblack from the respective control blocks $\mathbf{4}^R$, $\mathbf{4}^G$, $\mathbf{4}^B$ are connected to the inputs of the brightness limitation block 32. The output of the brightness limitation block, Brilim is fed back to the brightness block 8. With this configuration, it contributes the difference between the existing system and the proposed system.

Figure 7:
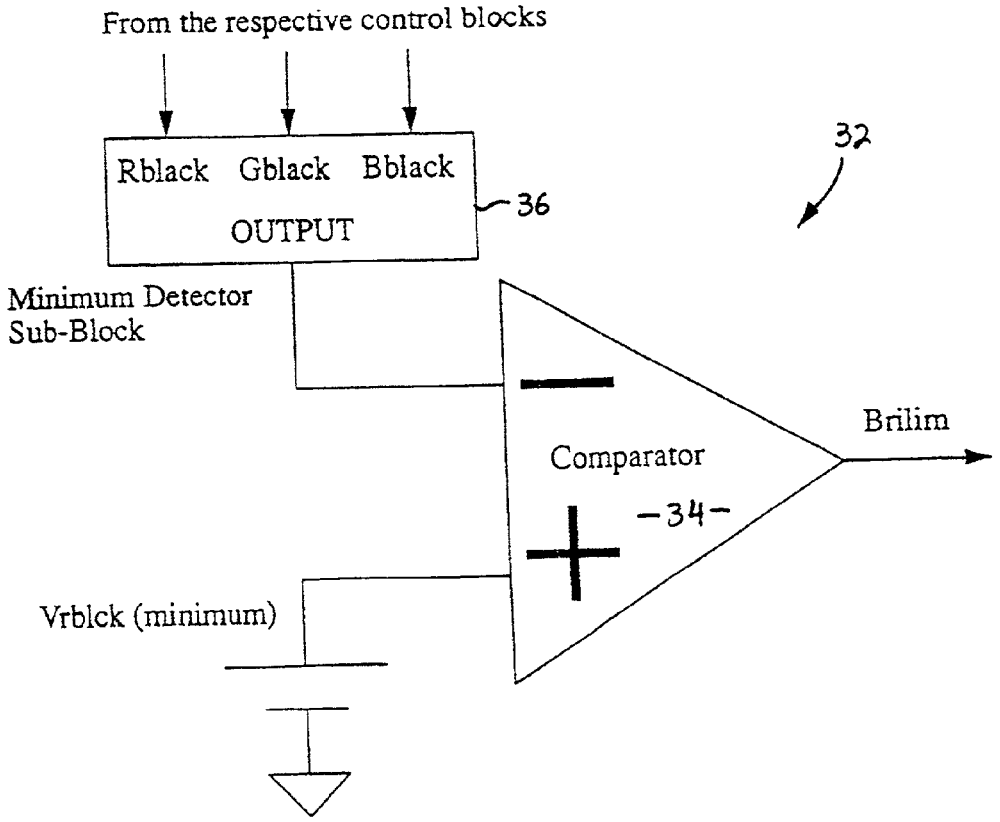
FIG. 7 is a block diagram of a brightness limitation circuit.

With reference to FIG. 7, a simple exemplary implementation of the brightness limitation block 32 is shown, including a comparator 34. A minimum detector 36 is introduced before the input of the comparator, which can be easily done using diodes. The output of the minimum detector is applied to the negative input of the comparator while the positive input of the comparator is maintained with a fixed voltage, Vrblck (minimum) with respect to ground.

The function of the minimum detector 36 is to select only one of the three input signals with the lowest voltage. Subsequently, this signal is reflected on the output of the minimum detector.

A comparison is made between the voltage at the negative input and the positive input of the comparator 34. If the voltage at the negative input is less than Vrblck(minimum) at the positive input of the comparator, a signal will be generated at the output, Brilim. The signal at Brilim will correspond to the amplitude between Vrblck(minimum) and the signal at the negative input of the comparator. This correction signal is fedback to the input of the brightness block 8. As such, the signal of Rblack is prohibited from entering the minimum signal clipping zone.

On the other hand, if the voltage at the negative input is greater than the Vrblck(minimum) at the positive input of the comparator, no signal is generated at the output, Brilim. Therefore, it is not necessary to add to the signal being passed to the brightness block as it did not enter beyond the minimum signal clipping zone.

Figure 8:
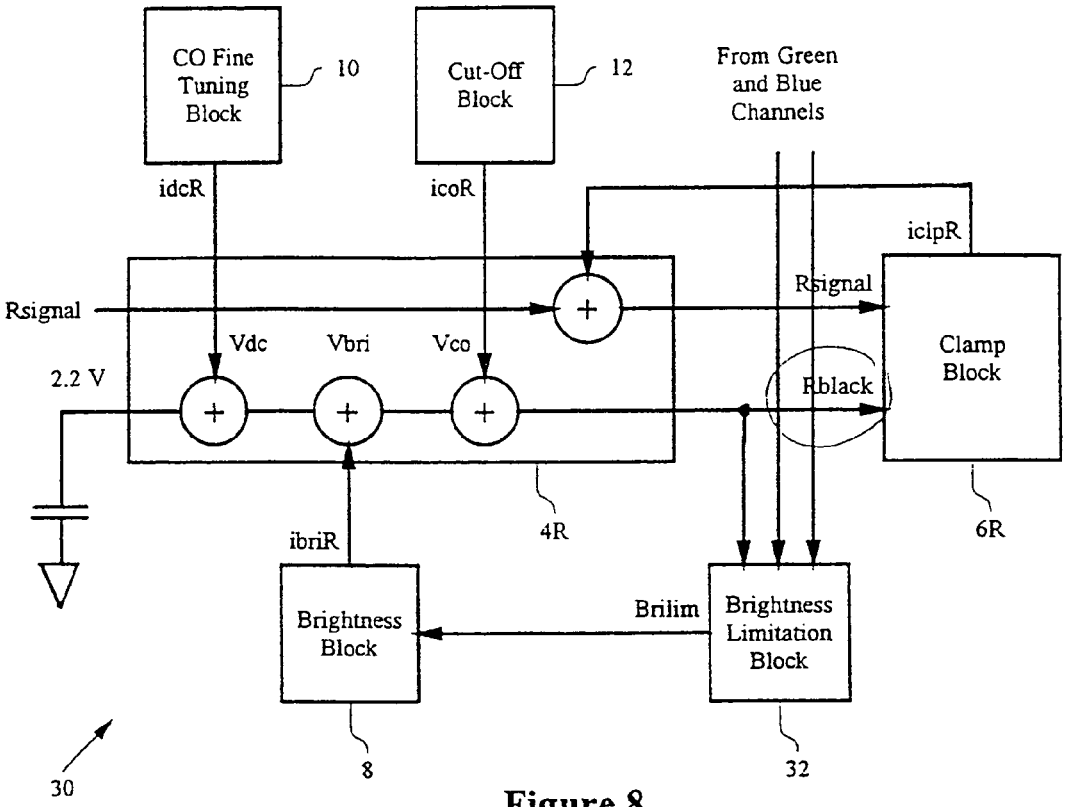
FIG. 8 is a simplified functional block diagram of a video signal control system according to an embodiment of the present invention.

FIG. 8 shows a simplified block diagram of the circuit 30 shown in FIG. 6 (for the red channel only), to further elaborate the detailed operation of the new system. Basically, the control block 4R comprises four adders: three adders are included along the Rblack signal path and one adder is included along the Rsignal path. The brightness block 8 is used to provide brightness adjustment, the CO fine tuning block 10 is used to provide DC adjustment, and the Cut-Off block 12 is used to provide CO adjustment.

As described above, if the Rblack signal from the control block 4R is less than Vrblck(minimum), a correction signal, Brilim, will be generated and fedback to the brightness block. In the brightness block the correction signal, Brilim, may be combined with a manual brightness adjustment signal, using an adder or the like, to form the ibriR signal provided to the control block. Subsequently, this signal is added to the Rblack signal so as to avoid it from falling into the minimum signal limitation zone.

Alignment is performed with the use of the clamp block 6R. A comparison is made between the Rblack and Rsignal signals. An iclpR signal is then generated at the output of the clamp block which indicates the amplitude difference of both signals if they are different. Eventually, iclpR signal is added into the Rsignal signal. As such, the Rsignal signal is superimposed on the Rblack signal and alignment has been done.

Example calculations are set forth below to illustrate how the Rblack signal is prevented from entering the minimum signal limitation zone with the implementation of the brightness limitation block as described above.

EXAMPLE 1

Assume that Vrblck(current)=2.2 volts,

Vco(minimum)=−1 Volt,

Vdc(minimum)=−0.15 Volt, and the brightness limitation block is intended to prevent Vrblck from falling below 0.5 Volt. It is possible then to determine what is the Vbri(minimum) that is required to be added into the control block.

Vrblck=Vrblck(current)−Vco−Vdc−Vbri from (Equ. 3)

0.5=2.2−1−0.15−Vbri

Thus, Vbri=−0.55 Volt, ideally Vbri(minimum)=−0.9 Volt

Figure 9:
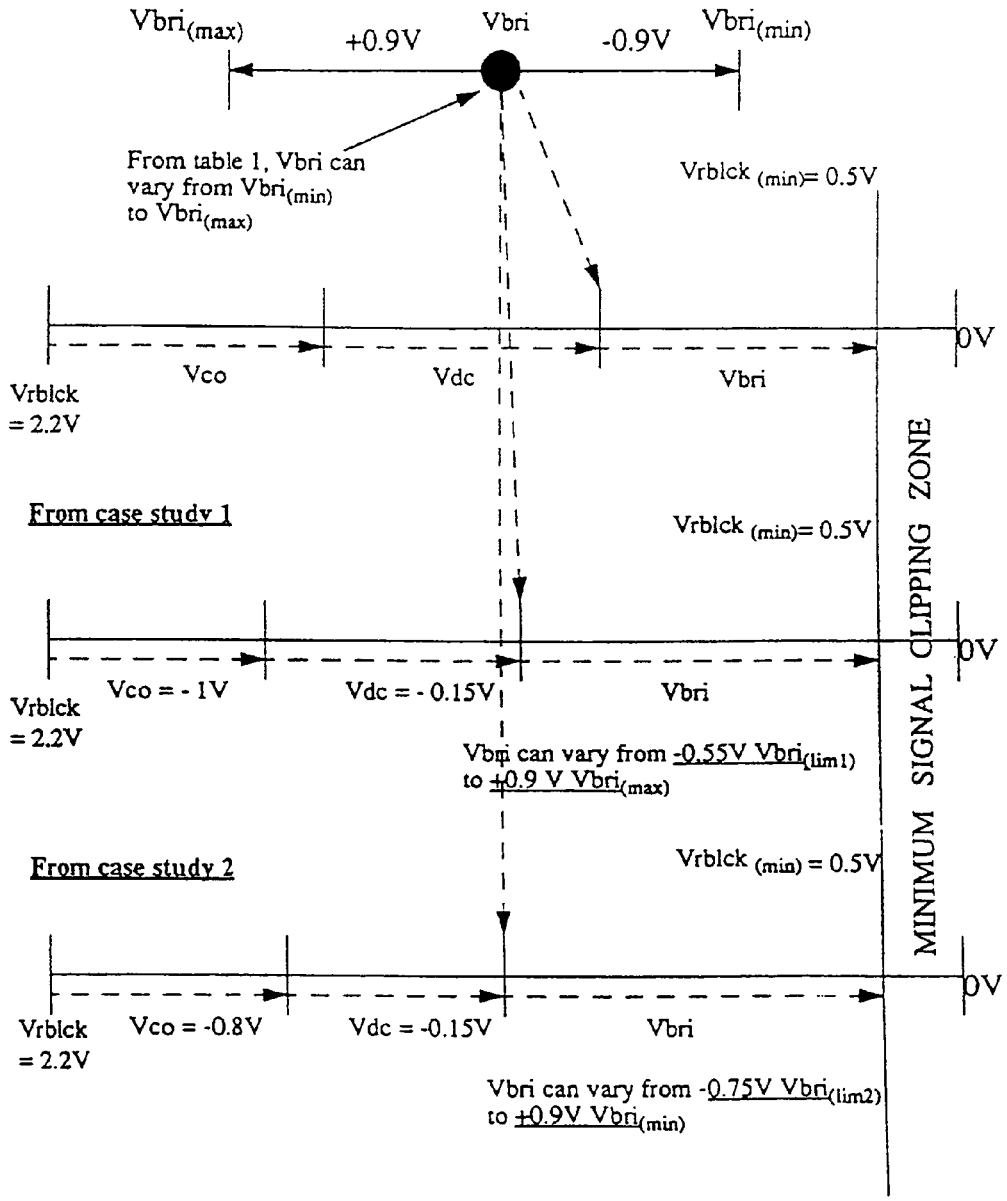
FIG. 9 shows several voltage range diagrams illustrating the operation of an embodiment of the invention.

Therefore, Vbri from the brightness block would be greater than −0.55 Volt, otherwise, it will cause Vrblck to fall into the minimum signal limitation zone. This indicates that there is a significant increase of voltage, Vbri from −0.9 Volt to −0.55 volt, to provide the correction (refer FIG. 9).

EXAMPLE 2

Assume that Vrblck(current)=2.2 Volts,
Vco=−0.8 Volt, and
Vdc(minimum)=−0.15 Volt.
It is possible then to determine the minimum Vbri.
Vrblck=Vrblck(current)−Vco−Vdc−Vbri from (Equ. 3)
0.5=2.2−0.8 0.15−Vbri Hence, Vbri=−0.75 Volt, ideally minimum Vbri=−0.9 Volt Therefore, Vbri from the brightness block should not be greater than −0.75 Volt. This indicates that there is a significant increase of voltage Vbri, from −0.9 Volt to −0.75 Volt, to provide the correction (Refer FIG. 9).

Based on simulation results of this system, it has been shown that the black reference voltage level and the video signal are prevented from entering into the minimum signal clipping zone. Moreover, a constant black reference voltage level and the video signal with dynamic amplitude are maintained.

The foregoing detailed description of the preferred implementations of the present invention has been presented by way of example only, and it is not intended to be considered limiting to the invention as defined in the appended claims and the equivalents thereof.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The invention claimed is:

1. A video signal processing system, comprising: for a plurality of color channels, a control circuit and clamping circuit for generating a color channel reference signal and controlling a color channel video signal for each color channel, a minimum signal detector that receives the color channel reference signals as input and is arranged to output, as a minimum signal level, a signal level of a color channel reference signal having only the lowest signal level from among the color channel reference signals, and a brightness limitation circuit coupled to receive the color channel reference signal from each of the color channels and coupled to provide a feedback signal to regulate a brightness level of each video signal according to a comparison of only the minimum signal level and a fixed reference signal level.

2. The video signal processing system of claim 1, wherein the brightness limitation circuit comprises a minimum detection circuit formed with diodes for detecting and outputting a minimum signal level of only one from amongst the color channel reference signals, and a comparator having as inputs said fixed reference signal level and said minimum signal level, and producing said feedback signal as output.

3. The video signal processing system of claim 2, wherein said comparator is coupled to receive said minimum signal level at its negative input and said fixed reference signal level at its positive input.

4. The video signal processing system of claim 2, wherein each said control circuit includes a plurality of adders coupled in the signal path of the corresponding color channel reference signal, and wherein said feedback signal is coupled as input to one of said adders.

5. The video signal processing system of claim 4, wherein said feedback signal is coupled from the brightness limitation circuit to the control circuit by way of a brightness control circuit which enables manual brightness adjustment of the color channels.

6. The video signal processing system of claim 5, wherein said brightness control circuit incorporates an adder for combining the feedback signal with a manual brightness adjustment signal.

7. The video signal processing system of claim 4, further including at least one cut-off adjustment circuit coupled to provide input to a respective adder in the signal path of the color channel reference signal in each control circuit.

8. The video signal processing system of claim 1, wherein each said control circuit includes an adder circuit coupled in the signal path of the corresponding color channel video signal, and wherein a feedback signal from said clamping circuit, generated according to the color channel video signal and the color channel reference signal, is coupled as input to the adder circuit.

9. A video signal brightness controller, comprising:

a plurality of color channel control means each coupled to receive as input a respective color channel video signal and color channel reference signal and to generate a respective adjusted color channel video signal and adjusted color channel reference signal;

a plurality of clamping means, each clamping means corresponding to a respective color channel control means and coupled to receive as input the respective adjusted color channel video signal and adjusted color channel reference signal and to produce a corresponding clamping feedback signal; and a brightness limitation means coupled to receive the adjusted color channel reference signal from each color channel control means to produce a corresponding brightness feedback signal based on a detection of a signal level of a color channel reference signal having only the lowest signal level among the plurality of adjusted color channel reference signals;

wherein each said color channel control means includes a first adder in path of the color channel video signal, to which said clamping feedback signal is coupled, and a second adder in the path of the color channel reference signal, to which said brightness feedback signal is coupled wherein said brightness limitation means comprises a minimum signal level detector or detecting the minimum signal level from among the plurality of adjusted color channel reference signals, and a comparator for generating said brightness feedback signal on the basis of the detected minimum signal level and a fixed reference signal level.

10. A method for regulating color channel video information signals, comprising the steps of receiving a plurality of color channel reference signals, outputting, as a minimum signal level, a signal level of a color channel reference signal having only the lowest signal level amongst the received plurality of color channel reference signals, comparing said minimum signal level with a fixed voltage reference signal and generating a corresponding comparator output, and providing an additive feedback coupling of said comparator output signal and each of said color channel reference signals wherein receiving the plurality of color channel reference signals comprises: receiving a plurality of color channel video signals and corresponding color channel reference signals and generating in response thereto respective adjusted color channel video signals and adjusted color reference signals; receiving the adjusted color channel video signals and adjusted color reference signals and generating in response thereto respective clamping feedback signals;

adding the clamping feedback signals to the color channel video signals; and receiving the adjusted color channel video signals and generating in response thereto a respective brightness limitation signal that is added to the color channel reference signal based on the detected signal level of an adjusted color reference signal having the lowest signal level from among the adjusted color reference signals.

11. The method of claim 10, wherein receiving the plurality of color channel video signals, corresponding color reference originals, adjusted color channel video signals, and adjusted color channel reference signals comprises:

receiving at a color channel control circuit the color channel video signals and color channel reference signals and generating in response thereto the adjusted color channel video signals and adjusted color reference signals;

receiving at a clamping circuit the adjusted color channel video signals and adjusted color reference signals and generating in response thereto clamping feedback signals; and receiving the clamping feedback signals at the color channel control circuit and adding the clamping feedback signals to the color channel video signals.

12. A video signal brightness control circuit for regulating brightness of at least one color video channel, comprising:

a brightness limitation control circuit configured to receive a plurality of color reference signals and configured to generate a feedback signal to regulate the brightness of the at least one color-video channel based on detection of a signal level of a color reference signal having only the lowest signal level from among the plurality of color reference signals wherein the feedback signal is responsive to a comparison between only a reference signal and the minimum signal level from the at least one color reference signal from the at least one color video channel; a plurality of color channel control circuits, each configured to receive a respective color channel video signal at a first adder and a color respective channel reference signal at a second adder and to generate a respective adjusted color channel video signal and a respective adjusted color reference signal; a plurality of clamping circuits, each coupled to a respective color channel control circuit to receive the adjusted color channel video signal and adjusted color reference signal and configured to generate a respective video clamping feedback signal that is received at the first adder of the respective color channel control circuit; and wherein the brightness limitation control circuit comprises a brightness limitation circuit coupled to each color channel control circuit and configured to generate a brightness feedback signal to the second adder in the respective color channel control circuit based on detection of signal level of an adjusted color reference signal having the lowest signal level among the adjusted color reference signals.

13. The video signal brightness control circuit of claim 12, comprising a brightness circuit coupled to the brightness limitation circuit for each of the color video channels and configured to generate a user-adjustable brightness limitation signal to the second adder in each of the plurality of color channel control circuits.

14. A video signal brightness control circuit for regulating brightness of at least one color video channel, comprising:

a brightness limitation control circuit configured to receive a plurality of color reference signals and configured to generate a feedback signal to regulate the brightness of the at least one color-video channel based on detection of a signal level of a color reference signal having only the lowest signal level from among the plurality of color reference signals, wherein the feedback signal is responsive to a comparison between a reference signal and the minimum signal level from the at least one color reference signal from the at least one color video channel;

a plurality of color channel control circuits, each configured to receive a respective color channel video signal at a first adder and a color respective channel reference signal at a second adder and to generate a respective adjusted color channel video signal and a respective adjusted color reference signal;

a plurality of clamping circuits, each coupled to a respective color channel control circuit to receive the adjusted color channel video signal and adjusted color reference signal and configured to generate a respective video clamping feedback signal that is received at the first adder of the respective color channel control circuit; and wherein the brightness limitation control circuit comprises a brightness limitation circuit coupled to each color channel control circuit and configured to generate a brightness feedback signal to the second adder in the respective color channel control circuit based on detection of signal level of an adjusted color reference signal having the lowest signal level among the adjusted color reference signals.

15. The video signal brightness control circuit of claim 14, comprising a brightness circuit coupled to the brightness limitation circuit for each of the color video channels and configured to generate a user-adjustable brightness limitation signal to the second adder in each of the plurality of color channel control circuits.

16. A method for regulating color channel video information signals, comprising the steps of:

receiving a plurality of color channel reference signals, outputting, as a minimum signal level, a signal level of a color channel reference signal having the lowest signal level amongst the received plurality of color channel reference signals, comparing said minimum signal level with a fixed voltage reference signal and generating a corresponding comparator output, and providing an additive feedback coupling of said comparator output signal and each of said color channel reference signals; and wherein receiving the plurality of color channel reference signals comprises:

receiving a plurality of color channel video signals and corresponding color channel reference signals and generating in response thereto respective adjusted color channel video signals and adjusted color reference signals;

receiving the adjusted color channel video signals and adjusted color reference signals and generating in response thereto respective clamping feedback signals;

adding the clamping feedback signals to the color channel video signals; and receiving the adjusted color channel video signals and generating in response thereto a respective brightness limitation signal that is added to the color channel reference signal based on the detected signal level of an adjusted color reference signal having the lowest signal level from among the adjusted color reference signals.

17. The method of claim 16, wherein receiving the plurality of color channel video signals, corresponding color reference originals, adjusted color channel video signals, and adjusted color channel reference signals comprises:

receiving at a color channel control circuit the color channel video signals and color channel reference signals and generating in response thereto the adjusted color channel video signals and adjusted color reference signals;

receiving at a clamping circuit the adjusted color channel video signals and adjusted color reference signals and generating in response thereto clamping feedback signals; and receiving the clamping feedback signals at the color channel control circuit and adding the clamping feedback signals to the color channel video signals.

* * * * *

UNITED STATES PATENT AND TRADEMARK OFFICE

CERTIFICATE OF CORRECTION

PATENT NO. : 7,154,563 B1
APPLICATION NO. : 09/674355
DATED : December 26, 2006
INVENTOR(S) : Chee Weng Yee et al.

It is certified that error appears in the above-identified patent and that said Letters Patent is hereby corrected as shown below:

Title Page

Item (75) Inventors, the names of the inventors have been incorrectly recorded. The names should read --Chee Weng Yee, SINGAPORE; Wei Guo Ge, CHINA; Yann Desprez-Le Gourant, SINGAPORE--.

Signed and Sealed this

First Day of May, 2007

JON W. DUDAS
*Director of the United States Patent and Trademark Office*